US008613310B2

(12) United States Patent
Denoix et al.

(10) Patent No.: US 8,613,310 B2
(45) Date of Patent: Dec. 24, 2013

(54) SPOOLING APPARATUS FOR WELL INTERVENTION SYSTEM

(75) Inventors: Henri Denoix, Chatenay-Malabry (FR); Charles Deible, Katy, TX (US); Denis Louis Yves Régníer, London (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 380 days.

(21) Appl. No.: 12/744,337

(22) PCT Filed: Nov. 20, 2008

(86) PCT No.: PCT/EP2008/009802

§ 371 (c)(1), (2), (4) Date: Oct. 19, 2010

(87) PCT Pub. No.: WO2009/065576

PCT Pub. Date: May 28, 2009

(65) Prior Publication Data

US 2011/0036558 A1 Feb. 17, 2011

(30) Foreign Application Priority Data

Nov. 23, 2007 (GB) ..... 0722981.8

(51) Int. Cl.
*E21B 19/22* (2006.01)

(52) U.S. Cl.
USPC ..... 166/77.2

(58) Field of Classification Search
USPC ..... 166/77.1, 77.2, 385
See application file for complete search history.

(56) References Cited

U.S. PATENT DOCUMENTS

| | | | | |
|---|---|---|---|---|
| 2,720,266 | A | 10/1955 | Broussard | |
| 2,810,439 | A | 10/1957 | Johnson et al. | |
| 3,415,317 | A | 12/1968 | Prosper | |
| 3,602,300 | A | 8/1971 | Jaffe | |
| 6,516,892 | B2 * | 2/2003 | Reilly | 166/384 |
| 2004/0040705 | A1 | 3/2004 | Harkins | |
| 2006/0048933 | A1 | 3/2006 | Van Way | |
| 2007/0158063 | A1 * | 7/2007 | Van Way | 166/77.2 |

FOREIGN PATENT DOCUMENTS

| | | |
|---|---|---|
| EP | 1696101 | 8/2006 |
| GB | 2152979 | 8/1985 |
| WO | 03/021301 | 3/2003 |
| WO | 2006/027553 | 3/2006 |

* cited by examiner

*Primary Examiner* — David Andrews
(74) *Attorney, Agent, or Firm* — Stephanie Chi; Jody DeStefanis

(57) ABSTRACT

A spooling apparatus for use with a well intervention system. The spooling apparatus comprises a pressure vessel capable of being maintained at the same pressure as the well, a flexible line housed in the pressure vessel such that it can be spooled into or out of the pressure vessel, and guidance means directing the flexible line to the outlet. The guidance means is arranged so as to decouple the angle of the flexible line to the outlet from the windings of the flexible line in the pressure vessel. Moreover, the apparatus can be incorporated into wellhead equipment.

15 Claims, 4 Drawing Sheets

SPOOLING APPARATUS FOR WELL INTERVENTION SYSTEM

CROSS-REFERENCE TO RELATED APPLICATIONS

The present application is based on and claims priority to GB Application No. 0722981.8, filed 23 Nov. 2007; and International Patent Application No. PCT/EP2008/009802, filed 20 Nov. 2008. The entire contents of each are herein incorporated by reference.

TECHNICAL FIELD

The invention relates to spooling apparatus allowing flexible lines such as power cable, tubing and the like to be fed into a well such as an oil or gas well. In particular the invention relates to such a system that allows intervention under pressure.

BACKGROUND ART

At different stages in the life of a producing oil or gas well, it is necessary to perform interventions; for example, to effect repairs or modifications in the production tubing assembly, or for modification of the producing zones by perforating or drilling new zones of the reservoirs. One approach is to kill the well (i.e. fill it with a dense fluid to balance the pressure of fluids in the underground formation and prevent their production into the well). While this does mean that the well is under control, it is lengthy and expensive and can lead to permanent damage of the producing formation. Interventions can also be performed without killing the well and with pressure at the well head. One of the issues with interventions under pressure is the deployment of the equipment through the well head under pressure.

Various interventions are usually done to maintain the producing tubing assembly, such as:

- cleaning of the well bore
- pumping of stimulation or cleaning fluids
- milling restrictions
- operations or repairs of valves Furthermore, to enhance production, more zones of the reservoir can be put to production by, for example, perforating new zones and or drilling lateral holes.

It is often required to perform these interventions without killing the well to avoid damage to producing zones by the invasion of killing fluids. This means that it is necessary to keep the well under balance or near balance with produced fluids or gas or light fluids. This also often implies pressure to be present at the well head.

These interventions may also involve circulating fluids to surface through tubes or hoses that need to exit the well at surface under pressure. Circulation can be "direct" by pumping down fluids through tubes or hoses or can be "reverse" with well fluids being circulated out through the deployed tubes or hoses.

Standard well head equipment (Christmas tree) and standard well head deployment equipment do not fully address these needs to deploy cables, tubes, pipes or hoses through a well head at surface and to allow circulation of fluids through these tubes, pipes or hoses.

One current approach to perform these types of interventions is to use coil tubing, but this involves very large and expensive surface equipment such as injectors and strippers. Safety coefficients for coil tubing are low and it is not widely accepted to circulate well fluids to surface with coil tubing.

Also, very high stress in coil tubing during deployment leads to fatigue and the possibility of failures not compatible with safe operation under pressure at surface. Another existing approach to perform these types of interventions is a pipe snubbing system, but this system has several limitations in terms of time performance and safety.

One proposal which allows pressure to be maintained in the well during an intervention is described in EP 1, 696,101, which describes the use of a secondary flow line housed on a drum inside a pressure vessel at the surface. The secondary line is relatively short compared to the depth of the well and is used to divert fluids while other pipe connections are being made.

The objective of the invention is to allow an easy deployment of long cables, tubes, pipes or hoses in a well under surface pressure in a timely and cost efficient manner with minimum requirements to the downhole equipment other than requirements arising generally from downhole operations. This invention also allows the production of well fluid through downhole conduit to surface safely without the need to design the conduit with the full safety coefficient usually required for surface equipment under pressure.

DISCLOSURE OF INVENTION

A first aspect of the invention provides a spooling apparatus for use with a well intervention system, comprising:

- a pressure vessel capable of being maintained at the same pressure as the well;
- a flexible line housed in the pressure vessel such that it can be spooled into or out of the vessel; and
- guidance means directing the flexible line to the outlet;

wherein the guidance means are arranged so as to decouple the angle of the line to the outlet from the windings of the line in the pressure vessel.

In one embodiment the apparatus further comprises a spool drum mounted for rotation in the pressure vessel wherein the flexible line is connected to the drum such that it can be spooled on or off the drum by rotation and the guidance means directing the flexible line from the drum to the outlet.

Preferably, the vessel is in the form of a cylinder and the drum is mounted with its rotation axis parallel to or perpendicular to the axis of the vessel.

The pressure vessel may be provided with rolling bars arranged around the exterior of the drum, the line being wound onto the drum within the rolling bars and at least one turn around the outside of the rolling bars before being lead to the outlet. Moveable end sheaves can be provided to guide the line from the rolling bars to the drum.

In one embodiment, the drum is moveable within the vessel with respect to the outlet to control the exit angle of the line. The drum can be moved laterally or by rotation around an axis.

The drum can be driven by electric or hydraulic motors which can be located inside or outside the vessel. Where the motor is located inside the vessel, it can preferably be located inside the drum core or alongside the drum.

The apparatus can form a part of well head equipment so as to be mountable coaxially with the well head such that the core of the drum embraces the well axis. The apparatus is preferably provided with means for guiding the line from the outside of the drum back down the core of the drum so as to enter the well. The apparatus may be connected to a lubricator which extends through the core of the drum to connect to the well head.

In another embodiment the apparatus comprises a basket mounted in the pressure vessel wherein the flexible line is contained within the basket such that it can be spooled out of or into the basket and the guidance means directing the flexible line from the basket to the outlet.

The basket can be mounted for rotation in the pressure vessel or may be fixed within the pressure vessel.

In a further embodiment the flexible line is wound against the inside of the pressure vessel.

The apparatus can further comprise a powered capstan wheel for relieving the tension in the line. Alternatively any other wheel arrangement or system for relieving tension can be used. The pressure vessel may also contain a powered winch to drive deployment of the line.

The flexible line can also be a hose to be deployed side by side with a wireline cable.

BRIEF DESCRIPTION OF FIGURES IN THE DRAWINGS

MODE(S) FOR CARRYING OUT THE INVENTION

The invention proposes the use of a pressure vessel at surface placed in the vicinity of the well head that contains the whole length of cable, tubes, hoses or electro-hydraulic umbilical (the term 'lines' will be used to cover all of these) preferably spooled on a drum. The pressure in the vessel is the same as the pressure of the well head. The lines are deployed from the pressure vessel to the well through a pressure pipe, compliant guide or lubricator, without crossing any pressure barrier.

The design of the pressure vessel can follow standard and accepted codes and rules for design, materials and manufacturing process leading to low cost equipment and high level of safety. This invention addresses issues relating to the installation of the spooling drum inside the pressure vessel and to facilitate the operations of spooling and unspooling.

Figure 1:
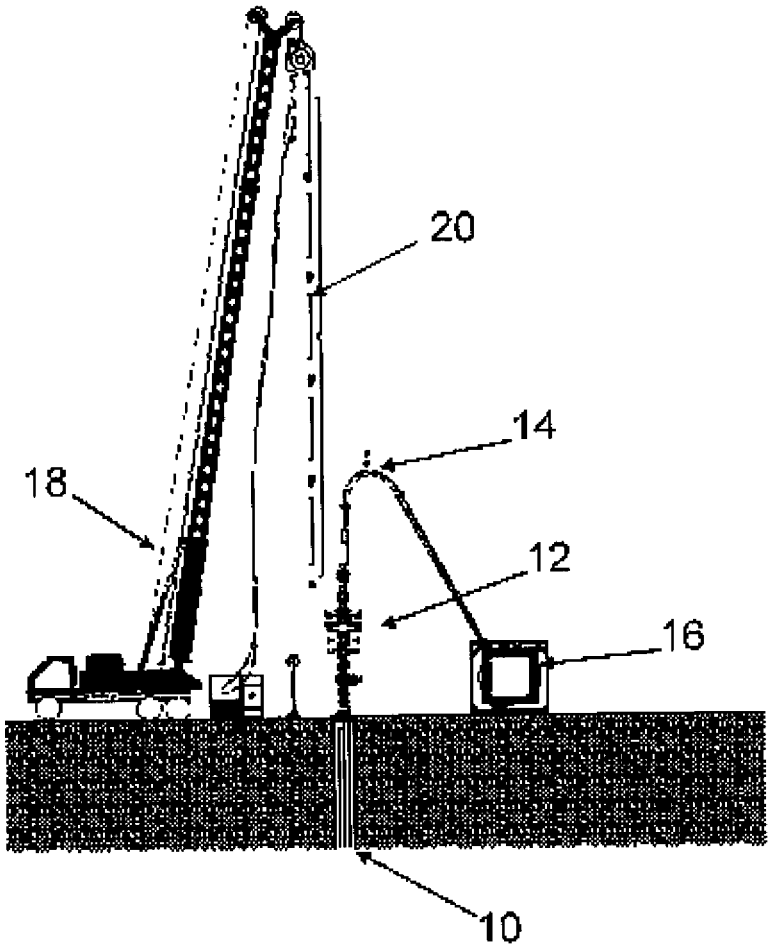
FIG. 1 shows a schematic view of a well site installation of an embodiment of the invention.

FIG. 1 shows a typical surface setup for a well intervention in which the invention can be used. The well 10 is provided with a conventional well head installation 12 including a lubricator. A pressure pipe 14 connects the top of the well head with a spooling apparatus 16 according to an embodiment of the invention which allows a line to be deployed into the well 10. A mobile crane 18 is situated near to the well to allow a tool string 20 to be lowered into the well through the well head 12.

Figure 2:
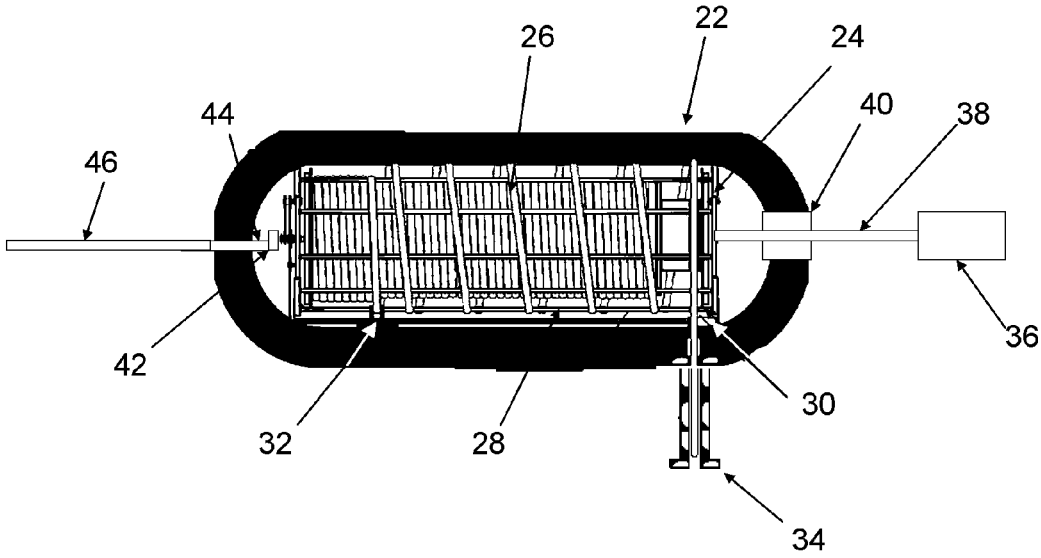
FIG. 2 shows detail of an embodiment of the invention.

FIG. 2 shows an embodiment of the invention. The spooling apparatus shown in FIG. 2 comprises a pressure vessel 22 having a spool drum 24 mounted therein. The pressure vessel 22 can be designed to reduce the size of the vessel and optimize the stress in the materials with cylindrical shape around the drum 24. In FIG. 2, the drum 24 has its axis parallel to that of the vessel 22. In another embodiment the vessel cylindrical axis is perpendicular to the drum axis to allow movement of the drum to allow adjustment of the exit angle of the drum.

To allow spooling/unspooling operations for any position on the drum 24 and while keeping a low angle of exit, the line 26 is taken around several turns around rolling bars 28 attached inside the vessel 22 while controlling the relative position of end sheaves 30, 32. End sheave 30 is fixed relative to the pressure pipe exit 34 which leads the line from the vessel 22 to the well and so controls the exit angle of the line 26. End sheave 32 is arranged to slide relative to the drum 24 and rolling bars 28 so as to ensure that the line 26 spools onto and unspools from the drum 24 in a controlled manner. Optionally, the drum 24 can be arranged to slide laterally in the vessel 22 so that the exit of the line 26 always faces the pressure pipe exit 34. In another embodiment, the drum 24 is arranged to rotate around an axis so that the exit of the line always faces the exit pressure pipe 34.

The operation of the drum 24 is controlled with electric or hydraulic motors 36 located outside of the vessel 22 with shaft 38 and a high pressure rotating seal 40 through the vessel envelope. Optionally the motor can be placed inside the vessel 22 inside the core of the drum 24 and or along the flange of the drum 24.

One particular concern when spooling lines onto or off a drum is the bending radius imposed by the spooling equipment on the line. Typical minimum bending radiuses for lines of these types are 40 or more times the line radius. A powered capstan wheel, wheels or other tension relieving device incorporated between the well head and the drum can significantly reduce the tension in the line when it is being spooled or unspooled. Spooling lines under reduced tension allows simplified equipment to be used to properly store the line onto the drum. Spooling under reduced tension also allows for a much reduced minimum bend radius of the line, thus reducing the size of the spooling equipment and storage drum. This is consistent with the need to keep the pressure vessel as small as possible.

Circulation of fluids can be provided through a rotating connector 42 from the line to a fixed pipe 44 inside the vessel 22 and to the outside of the vessel 22 through a high pressure fixed pipe 46. Electrical power and telemetry signals can be transmitted through a similar rotating connector and to the outside through a bulkhead in the pressure vessel.

Figure 3:
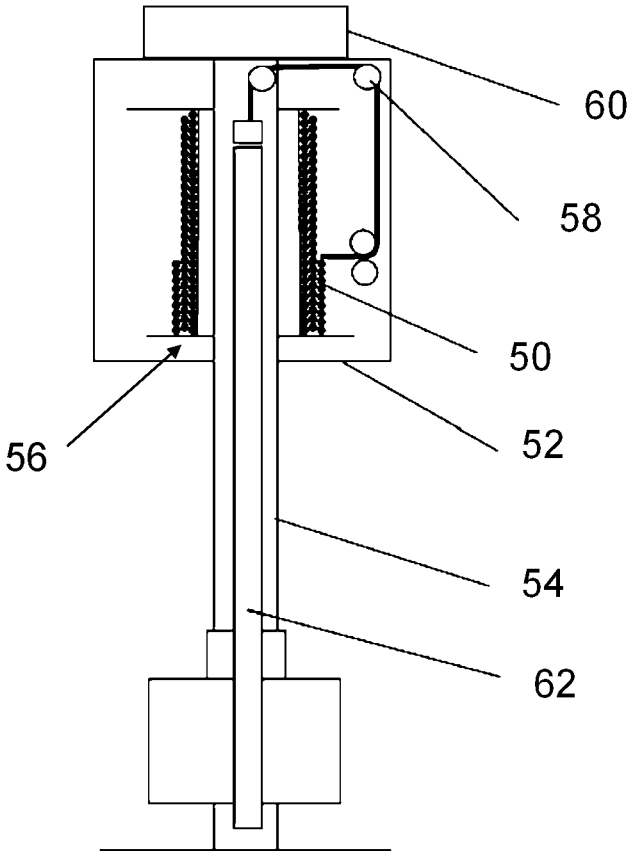
FIG. 3 shows a further embodiment of the invention.

FIG. 3 illustrates an embodiment here line properties allow (for example, a small cable 50 with sufficiently small bending radius), the pressure vessel 52 can be integrated into the well head control equipment that includes a lubricator 54. In this manner the core of the drum 56 is coaxial with the lubricator 54 and a set of sheaves 58 at the top is used to turn the cable 50 onto the wellbore axis. A winch drive and control 60 is integrated into the top of the package.

This arrangement is well suited to deploy long down-hole tools 62, where there is a requirement to deploy in sections, which are the length of the lubricator 54. One example is the deployment of short sections of pipe into the well bore. The system of the invention can be used to hoist the pipes when the lubricator is at zero pressure when picking up or laying down the pipes, and can be used to hoist the deployed pipe or BHA while at full wellhead pressure when making or breaking connections.

A winch integrated into the lubricator with a line that is enclosed so as to be exposed to well pressure can overcome some of the limitations of standard wireline pressure control. Running speeds are often limited in conventional 'atmospheric' pressure equipment due to concerns of loss of grease seal, and unseasoned cables can have difficulty maintaining seal in gas and higher pressure wells. When loss of seal occurs well fluids can escape into the environment causing many serious safety issues. If the well fluids contain $H_2S$ a serious health hazard is posed. Escaping gas can cause hydrates to form causing potentially very dangerous well control situations. Even in situations where well fluids are completely contained, the pressure control grease can accumulate at the top of the pressure control head where it is released into the environment. All of these problems can potentially be avoided or reduced using a system according to the invention.

Standard pressure control also requires additional weight to overcome the force of the well pressure pushing against the cable entering the well. In higher pressure wells the extra weight required can limit the length of tool deployed thus requiring more runs and lowering the efficiency of the operations.

Certain logging tools such as those used for production logging or reservoir monitoring can be made very small and compact. In many situations it is desirable to leave the tools deployed in a well over many days, weeks or even months. However, standard pressure control techniques are generally not suitable to this purpose. The invention allows for a very small tool string to be lowered into a well, as there is no need to overcome the pressure-area effect, and can be left unattended for an indefinite period of time, while the tool's measurements are monitored in real time via equipment at surface or transmission to a remote monitoring site.

Further the invention allows for the use of a small light weight cable, again because there is no need to overcome the pressure-area effect. A small lightweight cable has many advantages, in particular in the area of corrosion resistant cables. Typical corrosion resistant cables are very expensive due to their use of nickel alloys. The invention allows for the use of a smaller lightweight cable and thus reduces the amount of nickel alloy required for the cable.

A winch contained in a pressure vessel and integrated into the well head pressure control equipment can address these limitations by eliminating the need for a dynamic pressure seal on the line or wireline cable.

Figure 4:
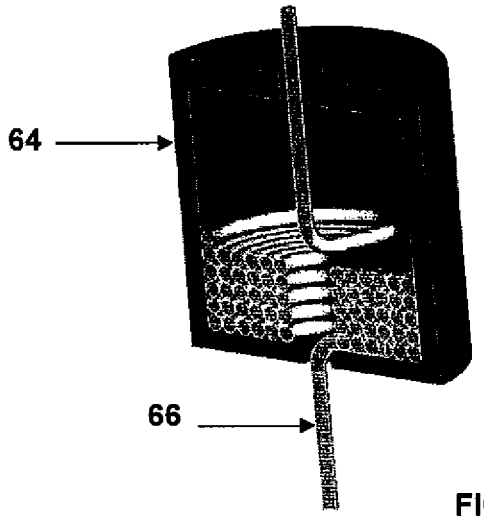
FIG. 4 shows details of a further embodiment of the invention.

When using a rotating drum inside a pressure vessel the drum consumes a large amount of space that could otherwise be used to store the line. Details of a further embodiment not requiring a drum to minimize the size required for the pressure vessel are shown in FIG. 4. In one embodiment of the invention to minimize the size required for the pressure vessel, the line can be wound inside a basket. The basket can be fixed in the pressure vessel or can be rotatably mounted within the pressure vessel. Guidance means direct the flexible line from the basket to the outlet. The guidance means may be constructed as discussed for the drum embodiment, and may be arranged to decouple the angle of the line to the outlet from the windings of the line in the basket and to provide a neat level wind within the basket. In another embodiment the line 64 could be wound against the inside of the pressure vessel 66 inwards, thus eliminating the need for a drum core.

In some situations the line is required to transport fluids, transmit electrical signals and hoist heavy loads. It may be the case where these functions can be split for example a conventional wireline cable can be combined with a fit for purpose hose. The wireline can be deployed through a conventional dynamic pressure seal and the hose deployed from within the pressure vessel. This allows for the reduction of the overall size of the pressure vessel. At a point before entering the well the hose and wireline are fastened together such that the wireline bears all the weight of the hose. The downhole tool and the hose are completely conveyed by the wireline, fluid is transported through the hose and electrical signals are transmitted through the wireline.

While the present invention has been described with respect to a limited number of embodiments, those skilled in the art having the benefit of this disclosure, will appreciate numerous modifications and variations therefrom. It is intended that the appended claims cover all such modifications and variations as fall within the true spirit and scope of this present invention.

What is claimed is:

1. A spooling apparatus for use with a well intervention system, comprising:

a pressure vessel capable of being maintained at the same pressure as the well;

a spool drum mounted for rotation in the pressure vessel;

a flexible line housed in the pressure vessel such that the flexible line can be spooled into or out of the vessel; and guidance means directing the flexible line to an outlet of the pressure vessel;

wherein the flexible line is connected to the spool drum such that the flexible line can be spooled on or off the spool drum by rotation and the guidance means can direct the flexible line from the spool drum to the outlet;

wherein the pressure vessel is provided with rolling bars arranged around the exterior of the spool drum, the flexible line being wound onto the spool drum within the rolling bars and at least one turn around the outside of the rolling bars before being lead to the outlet; and wherein a moveable end sheave is provided to guide the flexible line from the rolling bars to the spool drum.

2. Apparatus as claimed in claim 1, wherein the pressure vessel is in the form of a cylinder and the spool drum is mounted with its rotation axis parallel to or perpendicular to the axis of the pressure vessel.

3. Apparatus as claimed in claim 1, wherein the spool drum is moveable within the vessel with respect to the outlet to control the exit angle of the flexible line.

4. Apparatus as claimed in claim 3, wherein the spool drum can be moved laterally or by rotation around an axis.

5. Apparatus as claimed in claim 1, wherein the spool drum is driven by an electric or hydraulic motor which is located inside or outside the pressure vessel.

6. Apparatus as claimed in claim 5, wherein the motor is located inside the spool drum core or alongside the spool drum.

7. Apparatus as claimed in claim 1 forming part of well head equipment so as to be mountable coaxially with the well head such that the core of the spool drum embraces the well axis.

8. Apparatus as claimed in claim 7, further comprising means for guiding the flexible line from the outside of the spool drum back down the core of the spool drum so as to enter the well.

9. Apparatus as claimed in claim 7, wherein the pressure vessel is connected to a lubricator which extends through the core of the spool drum to connect to the well head.

10. Apparatus as claimed in claim 1 further comprising a basket mounted in the pressure vessel wherein the flexible line is contained within the basket such that the flexible line can be spooled out of or into the basket and the guidance means direct the flexible line from the basket to the outlet.

11. Apparatus as claimed in claim 10 wherein the basket is mounted for rotation in the pressure vessel.

12. Apparatus as claimed in claim 10 wherein the basket is fixed within the pressure vessel.

13. Apparatus as claimed in claim 1 wherein the flexible line is wound against the inside of the pressure vessel.

14. Apparatus as claimed in claim 1, wherein the pressure vessel contains a powered winch to drive deployment of the flexible line.

15. Apparatus as claimed in claim 1, wherein the flexible line is a hose to be deployed side by side with a wireline cable.

* * * * *